US006295777B1

(12) United States Patent
Hunter et al.

(10) Patent No.: US 6,295,777 B1
(45) Date of Patent: Oct. 2, 2001

(54) EXTERIOR FINISHING PANEL

(75) Inventors: Thomas Hunter, Lake Forest Park, WA (US); Randall Elinski, Jackson, MI (US); David Jacobson, Phoenixville, PA (US)

(73) Assignee: CertainTeed Corporation, Valley Forge, PA (US)

( * ) Notice: Subject to any disclaimer, the term of this patent is extended or adjusted under 35 U.S.C. 154(b) by 0 days.

(21) Appl. No.: 09/268,367

(22) Filed: Mar. 15, 1999

Related U.S. Application Data

(63) Continuation-in-part of application No. 29/079,812, filed on Nov. 19, 1997.

(51) Int. Cl.[7] ..... E04D 1/00

(52) U.S. Cl. ..... 52/519; 52/520; 52/539; 52/311.1; 52/796.1

(58) Field of Search ..... 52/519, 520, 539, 52/233, 796.1, 311.1

(56) References Cited

U.S. PATENT DOCUMENTS

| | | | | |
|---|---|---|---|---|
| 3,343,325 | * | 9/1967 | Curran | 52/478 |
| 4,186,538 | | 2/1980 | Marcum, Jr . | |
| 4,788,808 | * | 12/1988 | Slocum | 52/521 |
| 5,224,318 | | 7/1993 | Kemerer . | |
| 5,278,198 | * | 1/1994 | Grohman | 521/139 |
| 5,324,461 | * | 6/1994 | Grohman | 264/45.9 |
| 5,391,585 | * | 2/1995 | Grohman | 521/139 |
| 5,461,839 | * | 10/1995 | Beck | 52/519 |
| 5,486,553 | * | 1/1996 | Deaner et al. | 524/13 |
| 5,526,627 | * | 6/1996 | Beck | 52/519 |
| 5,700,555 | * | 12/1997 | Grill | 428/233 |
| 5,738,935 | | 4/1998 | Turk et al. . | |
| 5,739,935 | * | 4/1998 | Turk et al. | 428/304.4 |
| 5,858,522 | * | 1/1999 | Turk et al. | 428/308.8 |

OTHER PUBLICATIONS

Alcan Building Products, 1972.*
Alcan Building Products 1972, Alcan Building Products Driftwood pattern, one page.

* cited by examiner

*Primary Examiner*—Beth A. Stephan
*Assistant Examiner*—Dennis L. Dorsey
(74) *Attorney, Agent, or Firm*—Duane, Morris & Heckscher LLP

(57) ABSTRACT

A plastic sheet exterior finishing panel is provided which includes an inner layer of foamed plastic material and an outer layer of non-foamed plastic material joined to the inner layer and defining a facing surface formed to convey a desired aesthetic effect. At least the outer layer includes at least one organic, cellulosic additive for enabling the facing surface to be painted or stained. The panel may also be supported by at least one rigid support spine disposed at least along a portion of the length of the sheet. The support spine may be formed integrally with the panel. Alternatively, the support spine may be formed as a separate material having a flexural modulus which is greater than the flexural modulus of the thermoplastic sheet so as to stiffen the panel during handling, installation and use; the separate support spine is fastened or bonded to the rear of the panel, or coextruded.

18 Claims, 5 Drawing Sheets

EXTERIOR FINISHING PANEL

This application is a continuation in-part of U.S. patent application Ser. No. 29/079,812, filed Nov. 19, 1997.

FIELD OF THE INVENTION

The present invention relates in general to a finishing panel used on the exterior surfaces of buildings, as well as processes for making the panel.

BACKGROUND OF THE INVENTION

The exteriors of many residential and commercial buildings have long been protected by "finishing" or "sheathing" materials including wood, metal, and polymer resins. Metal sheathing such as aluminum siding was once very popular since it was more insect-and weather-resistant than wood siding and could be anodized, painted, or laminated to provide a plurality of colors and styles. Metal sheathing also proved to be long lasting and energy efficient. However, because it could not be easily sawed, clipped, or drilled with hand tools, it was relatively labor intensive to install. Additionally, metal sheathing materials had to be extremely thin to be cost efficient, and, because of their inherent lack of resiliency, were susceptible to irreversible dents, creases and other damage from minor impact, bending and other loads.

In more recent times, "vinyl siding" (which is typically a resinous composition containing polyvinyl chloride) has provided a less expensive and more impact-resistant material for exterior siding panels. This material can also be provided in a wide variety of colors and patterns, but is more flexible and forgiving and thus does not permanently deform under minor loads. Plastics like polyvinyl chloride are also easy to machine and can be worked with almost any hand tool at the construction site.

It has been found, however, that conventional vinyl siding has not always been satisfactory as an exterior sheathing material for irregular exterior wall surfaces. Due to poor pre-existing construction, material inconsistency, or foundation settling, exterior walls in both new and old constructions are not always flat. Since vinyl siding, as opposed to metal siding, is very flexible, it readily conforms to the irregularities of the wall surface and may produce a crooked, bowed, or otherwise aesthetically unpleasant finish upon installation.

In order to compensate for this deficiency, installers frequently must resort to using wooden shims which must be separately nailed to the support surface before the vinyl siding is installed. Attempts have also been made to loosely nail the siding to the support surface so that the siding "floats" over the uneven portions of the exterior wall. In order to float the siding over the irregularities, but still provide a relatively straight and orderly appearance, the panel must be fairly rigid so as to span high and low points along the wall. Unfortunately, polyvinyl chloride, even in its most rigid state, only has a flexural modulus of about $0.5\times10^6$ psi, and a tensile strength of about one-seventh of that of wrought aluminum.

Synthetic lumber (e.g., polymer-fiber composite lumber) has been used as a substitute for wood in areas where wood deteriorates quickly due to environmental conditions. Although in the past its commercialization was limited by costs, modern recycling techniques and low cost extrusion manufacturing capability have permitted greater penetration by polymer fiber composite materials into the commercial and residential markets. One such product manufactured under the trademark TREX, by Trex Company, LLC, Winchester, VA, consists of a polyethylene and wood fiber blend which is extruded into board dimensions for decking applications. These synthetic wood products are weather resistant and relatively maintenance free. Once installed, they resist splintering and warping normally associated with wood boards. They are also characterized by "color weatherability"; for example, the TREX® product initially is a light coffee brown color and converts to a weathered gray appearance when exposed to rain water and sunlight.

Polyethylene and wood composite boards do not require painting, and never include knots. Knots often result in damage to the surface of ordinary wood lumber and, usually, more difficult hammering or screwing of fasteners. These composite materials also do not shed sap, and have a smooth surface texture that is comfortable for even barefoot walking. Polyethylene and wood composite boards in ¾ inch thicknesses such as the "TREX®" board have sufficient rigidity to be used as decking planks. However, they are not suitable for siding or finishing panels because of their bulk and weight and considerable aesthetic dissimilarity to conventional siding panels.

In addition to polyethylene, other plastics have been suggested for use in the manufacture of synthetic wood products. Polyvinyl chloride thermoplastics have been used in combination with wood fibers to make extruded structural members. For instance, U.S. Pat. No. 5,486,553 assigned to Andersen Corporation of Bayport, Minn., discloses such components as substitutes for structural wooden members.

Rigid objects composed of foamed thermoplastic materials are also known. For example, U.S. Pat. Nos. 5,278,198, 5,324,461 and 5,391,585 disclose coextruded articles including a base layer of foamed polyvinyl chloride having at least one non-foamed, thermoplastic (preferably polyvinyl chloride) skin layer adhered thereto. The presence of foam during manufacture of the base layer results in a plurality of open cellular spaces being created in the base layer upon curing. Such voids or spaces reduce the density and weight of the foamed layer. Typically, however, foamed articles are not especially impact resistant. The non-foamed layer(s) provide the protection necessary to render the foamed polyvinyl chloride into viable rigid objects such as pipes and sheets.

Accordingly, a desire exists for a plastic siding panel that is aesthetically pleasing, rugged, resistant to bending or conforming to irregularities in exterior wall surfaces, low in cost, lightweight, and that can be painted or stained as well as worked with ordinary hand tools at the construction site.

SUMMARY OF THE INVENTION

The present invention is a finishing panel comprising an inner layer of foamed plastic material; and an outer layer of plastic material joined to the inner layer. The outer layer defines a facing surface formed to convey a desired aesthetic effect.

DETAILED DESCRIPTION OF THE INVENTION

Figure 1:
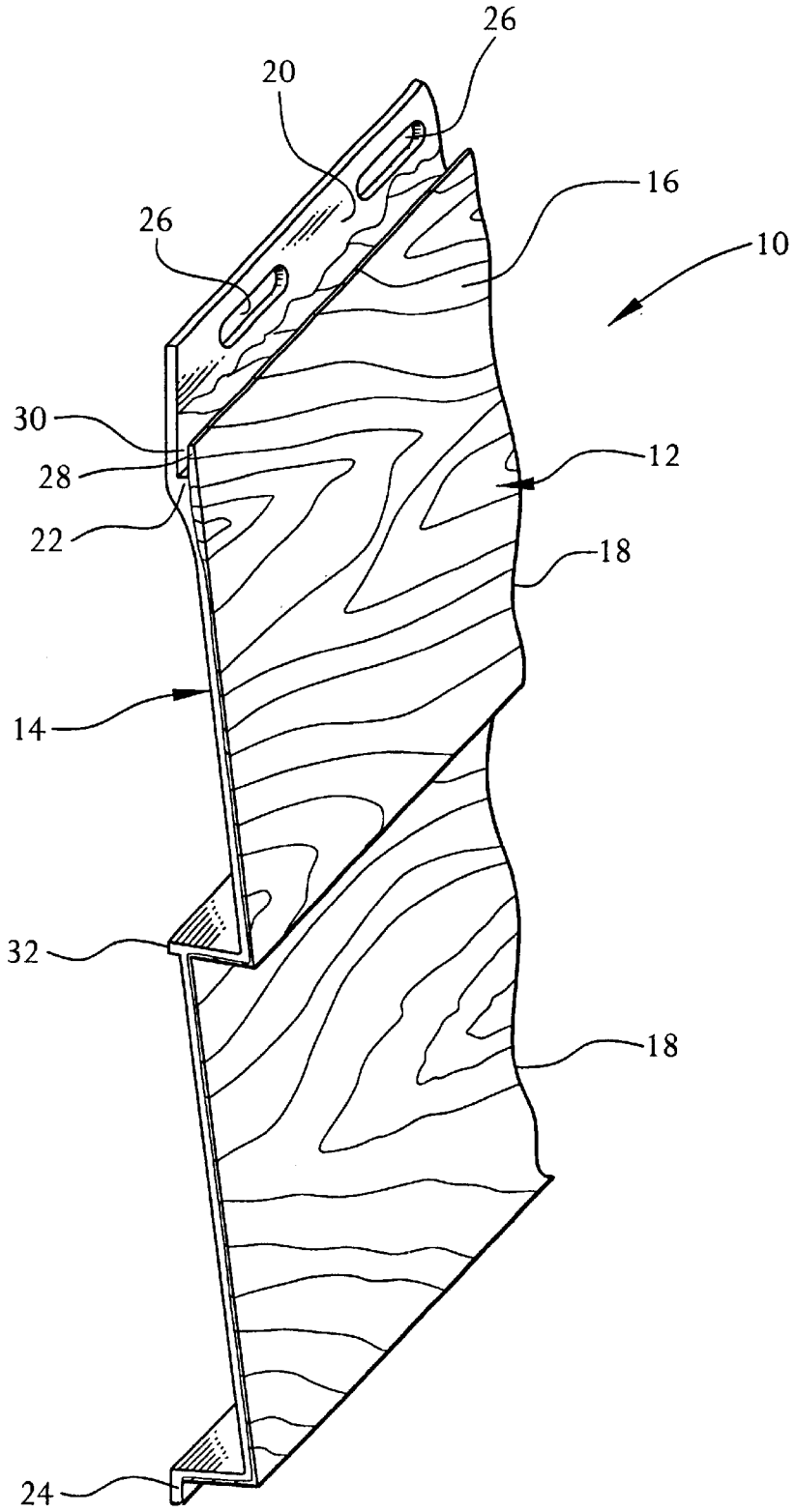
FIG. 1 is a partial side perspective view of an exterior siding panel constructed in accordance with one embodiment of the present invention.

The patent disclosures of the prior art contain no discussion of the aesthetics or visual impression to be conveyed by the outer skin layer or that the outer skin layer may be effectively painted or stained. Moreover, they do not disclose how to produce interlocking exterior finishing panels. And, apart from the essential chemical constituents of the base and skin layer compositions, the disclosures of the prior art indicate only that the compositions may also contain nucleating agents.

The present invention provides exterior finishing panels having aesthetically pleasing facing surfaces, yet which are substantially more rigid than conventional vinyl siding. The preferred panels comprise sheets of foamed, plastic material backing and facing which may be a non-foamed plastic material. The facing material may include one or more organic and/or inorganic additives to impart desired characteristics to the facing material, e.g., the ability to be painted or stained or to simulate the weathering of natural wood The panels may also comprise at least one substantially rigid support spine disposed along at least a portion of the lengths of the panels. The support spine may optionally be formed from a separate material having a flexural modulus (a quantitative measure of "stiffness") which is greater than the flexural modulus of the panel sheets.

The instant siding panels are stiffer and more resistant to bending along cracked, pitted, or bowed exterior wall surfaces than standard vinyl siding. The siding panels are reinforced to obtain a better "floating" effect along irregular surfaces. The panels are easier to handle because they are not as susceptible to bending. Moreover, they are easier to install because a stiff panel locks into another rigid stiff panel with less effort on a more consistent and predictable basis. Because the panels are stiffer, they can also be manufactured and deployed in longer lengths than the current 12 foot (3.6 meter) standard siding panel length. The reinforced exterior siding panels of the invention are also more resistant to wind damage and "blow offs", because their rigid supports tend to distribute the wind load more evenly to all of the nail heads.

According to the exemplary embodiments the siding panels are constructed as a plurality of elongated, simulated board members formed in drawn, molded or extruded sheets. The panels may include tongue-and-groove fastening means for permitting one siding panel to be joined in inter-engaging fashion with another similarly constructed panel.

The substantially rigid support spine may be fabricated from a variety of materials including metal, thermoplastic, or thermosetting polymers and can be adhered to, formed integrally with, or otherwise applied to the panel to reinforce it during handling, installation and/or use. Preferably, the support spine comprises a polymer matrix composite which can be easily cut with hand tools.

Other advantages of the present invention will be apparent to those of ordinary skill in the art in view of the description below.

Exterior finishing panels 10 according to the invention include a sheet of plastic optionally reinforced with a substantially rigid support spine 32 or 33 which greatly stiffens the panel without significantly detracting from its low cost or ability to be worked with conventional carpentry tools, such as steel drill bits, shears and saw blades. As used herein, the term "finishing panels" refers to exterior finishing layers, such as soffits, vertical and horizontal siding, and accessories thereto.

Figure 2:
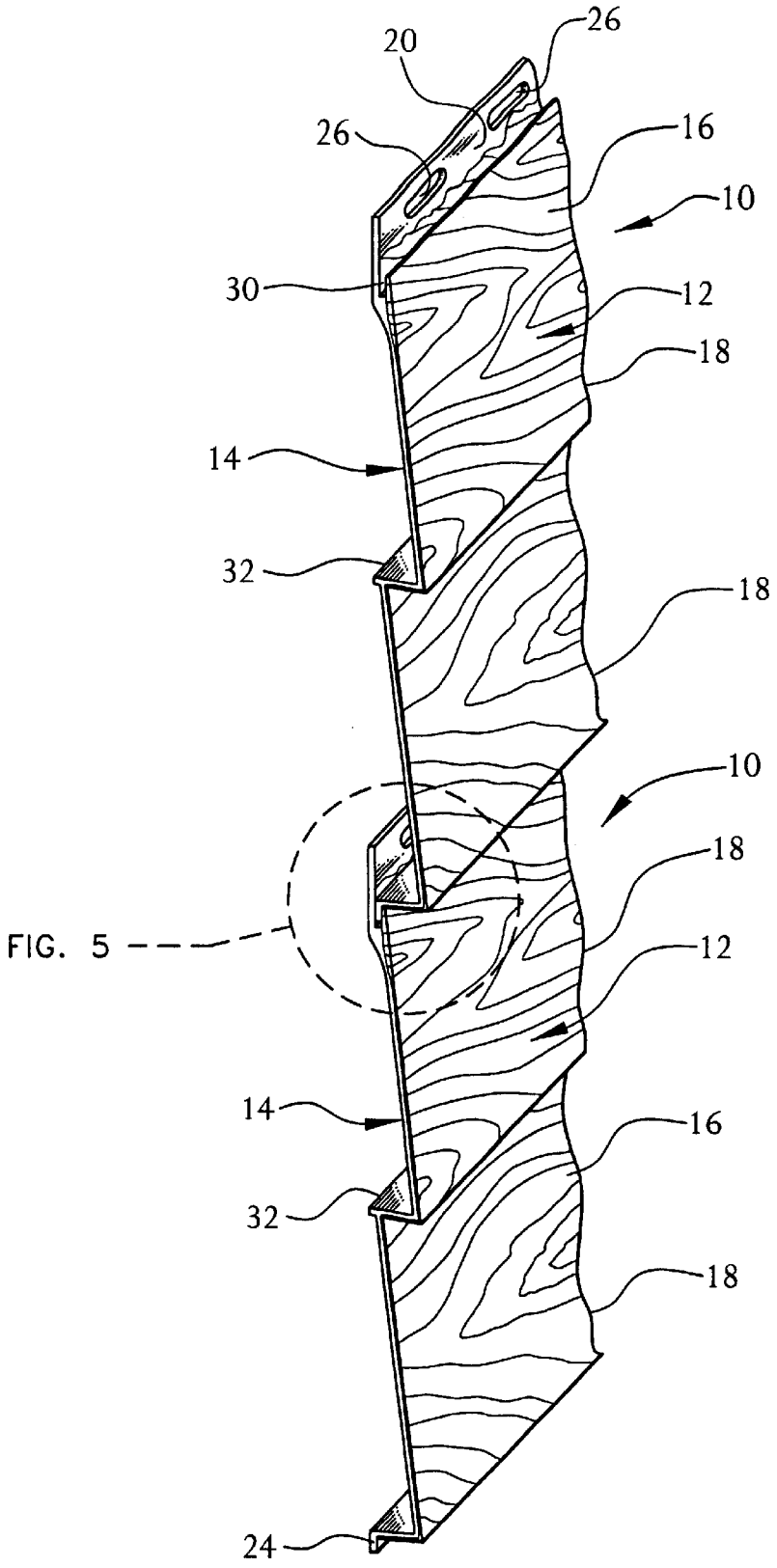
FIG. 2 is a partial side perspective view of two exterior siding panels according to the invention secured to one another by means of a tongue-and-groove connection.

FIGS. 1 and 2 show a finishing panel 10 according to the present invention. Panel 10 may be molded, drawn or extruded, as can the rigid support spine 32 described in detail below, to form part of a stiff, impact resistant, long lasting and easy-to-assemble system for erecting exterior finishing layers.

The process for fabricating finishing panel 10 may include a variety of conventional manufacturing techniques for thermoplastic and thermosetting materials. In this regard, panel 10 is desirably constructed as a unitary, elongated extruded sheet having front and rear faces whose width is delimited by upper and lower edges and whose length is delimited by first and second ends (only one such end, the left end, being shown in the FIGS.).

Figure 3:
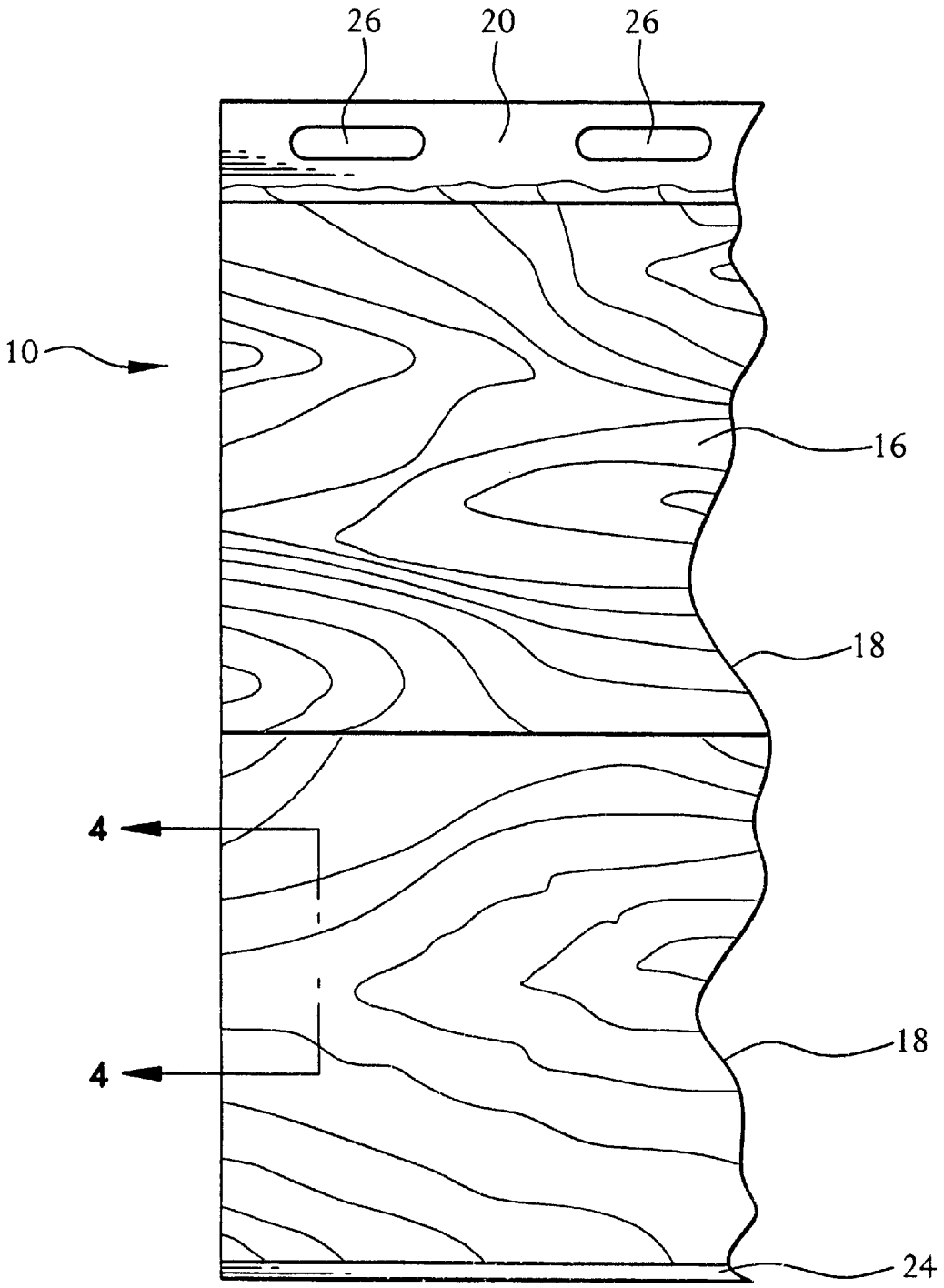
FIG. 3 is partial front elevation view of the exterior siding panel of FIG. 1.
Figure 4:
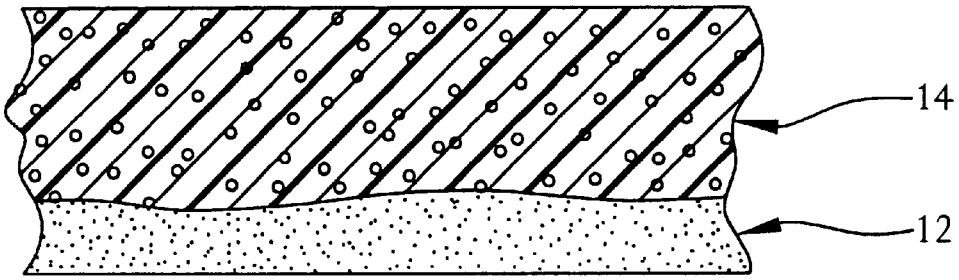
FIG. 4 is a cross-sectional view taken along line 4—4 of FIG. 3.

More particularly, panel 10 is preferably formed as a coextrusion comprising an outer layer 12 joined to an inner layer 14. The layers 12, 14 may be shaped to assume the longitudinal and cross-sectional profiles of any exterior siding design such as, for example, that shown in FIGS. 1 through 3. Outer layer 12 defines an exterior or facing surface 16 which may be formed to convey any desired aesthetic or decorative effect. For example, facing surface 16 may assume any smooth or textured appearance including, without limitation, simulated wood grain (as illustrated). Panel 10, or at least outer layer 12, may also include a pigment for coloration and can be subjected to further molding, calendaring, finishing or other machining to provide a simulated wood grain or other fanciful texture at facing surface 16.

Panel 10 may be formed to resemble a single board, slat or similar elongated siding member. Preferably, however, the panel incorporates, as shown, two or more overlapping simulated siding members 18 to provide greater structural integrity and enable faster installation. In the exemplary embodiment, a mixture of polyvinyl chloride pellets containing appropriate additives, as set forth below, is heated and extruded through a die to produce panels 10 having lengths of about 4–20 feet, and preferably about 8 to 16 feet, in length.

In the exemplary embodiment, a flange or lip 20 extends upwardly from a substantially horizontal shoulder 22 along the upper edge of panel 10. Similarly, panel 10 further preferably includes a flange or lip 24 extending downwardly along the lower edge of the panel. Lip 20 is preferably of sufficient height to accommodate apertures 26 for receiving fasteners such as screws, nails, or the like (not shown), for securing panel 10 to an exterior wall or other surface of a building.

Lip 20 and shoulder 22 cooperate with a second, forwardly disposed, upwardly extending lip 28 of lesser height than lip 20 to define a channel 30. Channel 30 is dimensioned to receive the lower lip 24 of an adjacent panel 10 to form a tongue-and-groove type connection between the panels in the manner depicted in FIGS. 2 and 5. The relative positions of lip 24 and channel 30 may be reversed from those shown in FIG. 1. That is, panel 10 may be constructed such that lip 24 extends upwardly along its upper edge and channel 30 opens downwardly along its lower edge. Channel 30 may also be of suitable dimensions to accommodate at least one substantially rigid support spine 33, described hereinafter, that may be adapted for disposition along lip 24 and shoulder 22.

The preferred materials for fabricating panel 10 include composites generally containing about 35–75 wt.% resinous materials, such as thermoplastic and thermosetting resins, for example, polyvinyl chloride (PVC), polyethylene, polypropylene, nylon, polyesters, polysulfones, polyphenylene oxide and sulphide, epoxies, cellulosics, etc. Preferred thermoplastic materials for panels 10 include PVC and copolymers and alloys thereof. Vinyl chloride monomer is made from a variety of different processes involving the reaction of acetylene and hydrogen chloride and the direct chlorination of ethylene. PVC is typically manufactured by the free radical polymerization of vinyl chloride. After polymerization, PVC is commonly combined with impact modifiers, thermal stabilizers, lubricants, plasticizers, organic and inorganic pigments, fillers, biocides, processing aids, flame retardants or other commonly available additive materials, when needed.

PVC can also be combined with other vinyl monomers in the manufacture of PVC copolymers. Such copolymers can be linear copolymers, graft copolymers, random copolymers, regular repeating copolymers, block copolymers, etc. Monomers that can be combined with vinyl chloride to form PVC copolymers include acrylonitrile, alpha-olefins such as ethylene, propylene, and the like, chlorinated monomers such as vinylidene dichloride, acrylate monomers such as acrylic acid, methylacrylate, methylmethacrylate, acrylamide, hydroxethyl acrylate, and others, styrenic monomers such as styrene, alpha methyl styrene, vinyl toluene, and the like, vinyl acetate, or other commonly available ethylenically unsaturated monomer compositions. Such monomers can be used in an amount of up to about 50 mol-%, the balance being vinyl chloride. PVC can be compounded to be flexible or rigid, tough or strong, to have high or low density, or to have any of a wide spectrum of physical properties or processing characteristics. PVC resins can also be alloyed with other polymers, such as ABS, acrylic, polyurethane, and nitrile rubber to improve impact resistance, tear strength, resilience, or proccessability. They can be produced water-white in either rigid or flexible compositions, or they can be pigmented to almost any color.

In the preferred embodiments of this invention, rigid PVC, optionally containing a small amount of plasticizer, is employed. This material is hard and tough and can be compounded to have a wide range of properties, including impact resistance and weatherability, e.g., fading color to a wood grey appearance. It also has a tensile strength of about 6,000–7,500 psi, a percent elongation of about 40–80%, and a tensile modulus of about $3.5–6.0\times10^6$ psi. It can be acceptably used without chlorination, at temperatures up to about 140° F., and with chlorination at temperatures up to about 220° F. It also has a coefficient of thermal expansion of about $3–10\times10^{-5}$ inch/inch-° F.

The outer layer 12 of finishing panel 10 also preferably contains about 25–65 wt.% fiber, such as glass, wood, cotton, boron, carbon, or graphite fibers preferably having a specific gravity of less than about 1.25 g/cc or, more preferably, about 0.5–1.2 g/cc. Additionally, inorganic fillers, such as calcium carbonate, talc, silica, etc. can be used. Preferably, the fibers are "cellulosic" in nature. Cellulosic fibers can be derived from recycled paper products, such as agrifibers, pulp, newsprint, softwoods, such as pine, spruce or other conifers, or hardwoods from deciduous trees. Hardwoods are generally preferred for fiber manufacture because they contain and absorb less moisture than softwoods. While hardwood is a preferred source of fiber for the invention, fiber can also be derived from a number of secondary sources such as natural fibers including bamboo, rice, and sugar cane, and recycled or reclaimed fibers from newspapers, cardboard boxes, computer printouts, etc. The present invention also contemplates utilization of wood flour of about 10–100 mesh, preferably 40–80 mesh in size.

In the preferred processes of the present invention, a quantity of PVC (which may include 10–100% regrind in small chunks) is mixed with about 40–80 mesh wood flour of about grass-seed size which has been pre-dried to release any trapped moisture as steam. The mixture also includes a melt enhancer, such a high molecular weight acrylic modifier, which improves melt elasticity and strength and enhances cellular structure, cell growth and distribution. The presence of wood and related organic fiber material in the PVC material of outer layer 12 produces a finishing panel 10 which minimizes the disadvantages of (and possesses many of the advantages of) hardboard, cedar and vinyl siding products. For instance, panels 10 have a comparatively low coefficient of thermal expansion versus both natural and vinyl siding products; they decay at a far lower rate than purely natural siding; they may be nailed to a structure as effectively as either natural or vinyl sidings; and, like natural siding (but unlike vinyl siding) they may be painted or stained to suit the end-user's tastes.

A chemical blowing agent or gas is preferably added to the mixture forming at least the inner layer 14 to reduce the density and weight of the panel 10 by virtue of the cellular voids produced by foaming. If a chemical blowing agent is used, it is mixed into the compound during blending or at the feed throat of the extruder. In the extruder, the blowing agent is decomposed, thereby dispersing gas, such as nitrogen or $CO_2$, into the melt. As the melt exits the extrusion die, the gas sites experience a pressure drop expanding into small cells or bubbles trapped by the surrounding polymer.

Chemical blowing agents may be any of a variety of chemicals which release a gas upon thermal decomposition. Chemical blowing agents may also be referred to as foaming agents. The blowing agent, or agents, if more than one is used, can be selected from chemicals containing decomposable groups such as azo, N-niroso, carboxylate, carbonate, hetero-cyclic nitrogen-containing and sulfonyl hydrazide groups. Generally, they are solid materials that liberate gas when heated by means of a chemical reaction or upon decomposition. Representative compounds include azodicarbonamide, bicarbonates, dinitrosopentamethylene tetramethylene tetramine, p,p'-oxy-bis (ben-zenesulfonyl)-hydrazide, benzene-1,3-disulfonyl hydrazide, aso-bis-(isobutyronitrile), biuret and urea.

The blowing agent may be added to the polymer in several different ways which are known to those skilled in the art, for example, by adding the solid powder, liquid or gaseous agents directly to the resin in the extruder while the resin is in the molten state to obtain uniform dispersion of the agent in the molten plastic. Preferably the blowing agent is added before the extrusion process and is in the form of a solid. The temperature and pressure to which the foamable composition of the invention are subjected to provide a foamed composition may vary within a wide range, depending upon the amount and type of the foaming agent, resin, and cellulosic fiber that is used. Preferred foaming agents are selected from endothermic and exothermic varieties, such as dinitrosopentamethylene tetramine, p-toluene sulfonyl semicarbazide, 5-phenyltetrazole, calcium oxalate, trihydrazino-s-triazine, 5-phenyl-3, 6-dihydro-1,3,4-oxadiazin-2-one, 3,6-dihydro 5,6-diphenyl-1,3,4 oxadiazin-2-one, azodicarboamide, sodium bicarbonate, and mixtures thereof.

In addition to the above, a coloring agent may be added to the compounded mixture, such as dyes, colored pigments, or flyash, or a mixture of these ingredients depending on the resulting color, and cost considerations. Such additives can provide either "weatherability", i.e., a gradual fading from a fresh wood color to a greyish weathered wood color, or a permanent tint, such as blue, green or brown.

As indicated above, the panel 10 may include an optional rigid support spine 32. The support spine 32 has two functions: (1) it acts as a spacer to hold the bottom of a panel section 18 away from the building surface to which the panel is mounted; and (2) the support spine acts as a reinforcement so that the panel 10 maintains a relatively straight shape, even if the underlying wall surface is irregular. Examples of reinforced finishing panels are provided in U.S. Pat. Nos. 5,461,839 and 5,526,627, which are incorporated herein by reference in their entireties.

Figure 5:
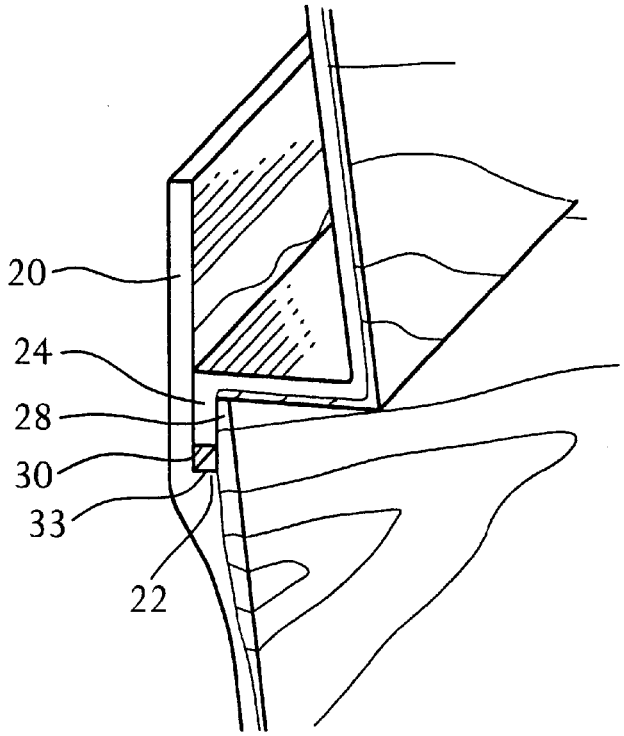
FIG. 5 is an enlarged view of the encircled portion of FIG. 2.

Referring to FIG. 5, the support spine 38 is alternatively an elongated member of narrow thickness or diameter (preferably about 0.1–0.2 inches), that may be disposed substantially along the length of the channel 30 in the siding panel 10. Although one or more rigid support spines of lesser length than channel 30 may be disposed along the channel, a preferred panel stiffening means construction is a single rigid support spine 33 of substantially the same length as channel 30.

In a preferred embodiment, e.g. (FIG. 1), the rigid support spine 32 may be formed (e.g., molded or extruded) integrally with the panel 10 (i.e., from the same piece of material as the panel) to reinforce the panel 10 at a single location or at multiple locations along its width. Referring to FIG. 1, the support spine 32 is located at a base of one of the siding members and projects inwardly away from the base.

Figure 6:
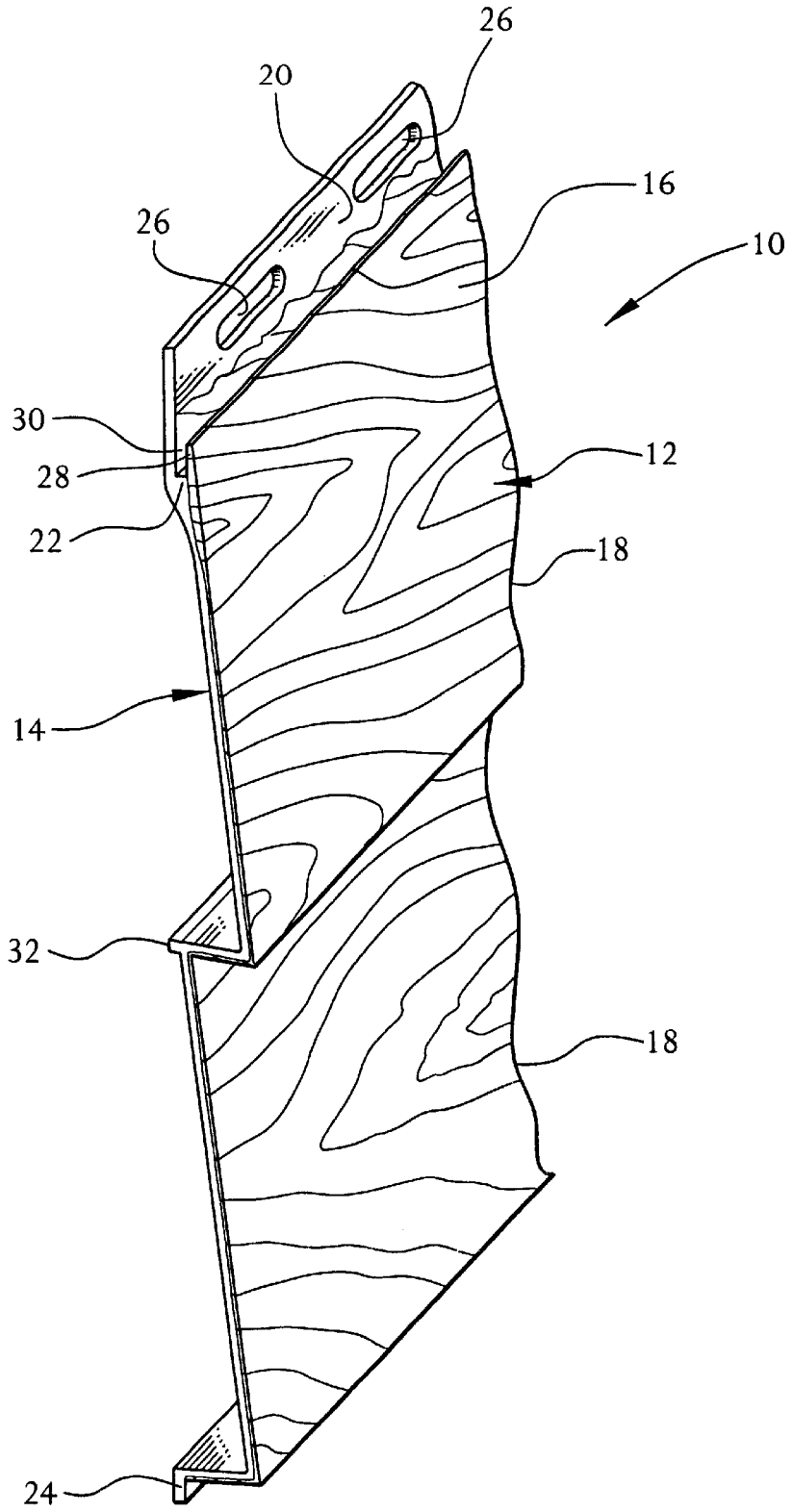
FIG. 6 is a partial side perspective view of an exterior siding panel constructed in accordance with another embodiment of the present invention.

In an alternative embodiment, the support spine 32 may be formed from a separate material, and may be bonded or fastened to the panel 10, or may be formed as a coextrusion. See FIG. 6. The potential advantage of using a separate material for the support spine 32 is the ability to control the material properties of the support spine 32 separately from the properties of the panel 10.

If formed from a separate material, the rigid support spine 32 preferably has a flexural modulus greater than, preferably at least about 50% greater than, and more preferably at least 100% greater than, the flexural modulus of the thermoplastic sheet. Materials that satisfy this criterion for PVC panels such as panel 10 include wood, most metals, including brass, aluminum, steel, and many thermoplastic and thermosetting resins. Of these, reinforced polymer-matrix-composites (PMCs) are desirable materials because of their high strength-to-weight ratio.

Unreinforced engineering thermoplastics typically have a tensile strength in the range of about 55–100 MPa (about 8–15×$10^3$ psi). For instance, unreinforced nylon 6/6, has a tensile strength of about 83 MPa (about 12×$10^3$ psi) and a tensile modulus of about 34 GPa (about 5×$10^6$ psi). However, unlike metals such as aluminum or steel, stiffness in plastics is guided by the flexural modulus. In applications involving low strain, however, such as those found in vinyl siding, tensile and flexural module are close to being identical for design purposes.

It is known that by reinforcing thermoplastic and thermosetting polymers, the stiffness of these resins can be dramatically increased. The addition of short glass fibers at about 5–30% (by weight) boost the tensile strength of engineering plastics by about a factor of two; carbon fibers, even further.

On the high end of the composite material spectrum are advanced PMCs reinforced with high-modulus and high-strength graphite fibers, a unidirectional PMC laminate typically has a tensile modulus of about 138–200 GPa (20–29×$10^6$ psi) and about a 1,138–1,552 MPa (165–225×$10^3$ psi) tensile strength. Other reinforcing fibers for advanced composites include boron, S-glass, E-glass, carbon fibers, long glass fibers, and aramid.

Advanced PMCs have higher specific strength and stiffness than most metals, and the ability to selectively place fibers for design versatility. Varying fiber orientation, concentration, and even generic fiber type, permits tailoring of stiffness and strength to a specific application. Braiding and weaving of the reinforcements have also been used to produce strength to a specific application. Braiding and weaving of the reinforcements have also been used to produce stronger components. Techniques using unreinforced liquid-crystal polymers (LCPs), high strength graphite fibers, polyphenylene benzobisthiazole (PBT), and polyphenylene benzobisoxozole (PBO) fibers have also produced high strength polymer-matrix-composites with environmental stability.

The rigid support spine 32 may also contain thermoplastic materials, for example, thermoplastic polyimides, polyesters, and nylons. Because of their inherently faster processing (no time-consuming curing or autoclaving), thermoplastic matrix-composites are preferred versus conventional thermoset composites. Some current examples of processing techniques include lamination, filament winding, and pultrusion. Thermoforming, hot stamping of consolidated sheet, and roll forming processes are also promising techniques for producing the support spine 32.

A comparison of the mechanical properties for selected polymer-matrix-composites, polyvinyl chloride, steel and aluminum suitable for use in the formation of rigid support spine 32 is shown in Table 1.

TABLE 1

Mechanical Properties of Polyvinyl Chloride, Unidirectional Advanced PMCs[1], Glass Fiber-Reinforced PMCs. Steel. and Aluminum

| | Tensile Strength, × $10^3$psi | Tensile Modulus, × $10^6$ psi | Flexural Strength, × $10^3$ psi | Flexural Strength, × $10^6$ psi |
|---|---|---|---|---|
| Boron/Epoxy | 199 | 29.2 | — | — |
| Boron/Polyamide | 151 | 32.1 | — | — |
| S-Glass/Epoxy | 187 | 8.8 | — | — |
| High-Modulus Graphite/Epoxy | 122 | 27.5 | — | — |
| High-Modulus Graphite/Polyamide | 117 | 31.3 | — | — |
| High-Strength Graphite/Epoxy[2] | 218 | 21.0 | — | — |
| Aramid/Epox[3] | 172 | 12.2 | — | — |
| High-Strength Graphite/Epoxy[4] | 220 | 16.0 | — | — |
| Polyvinyl Chloride (Rigid) | 7.5 | 0.6 | — | — |
| Polyvinyl Chloride (Flexible) | 1.5 | — | — | — |
| Glass/Comp. Molded Polyester BMC[4] | 6.0 | 1.75 | 12.8 | 1.58 |
| Glass/Inj. Molded Polyester BMC[4] | 4.86 | 1.53 | 12.65 | 1.44 |
| Glass/Comp. Molded Polyester SMC[5] | 23.0 | 2.27 | 45.0 | 2.0 |
| Glass/Comp. Molded Polyester SMC[5] | 12.0 | 1.7 | 26.0 | 1.6 |
| Glass/Comp. Molded | 5.3 | 1.7 | 16.0 | 1.4 |

TABLE 1-continued

Mechanical Properties of Polyvinyl Chloride, Unidirectional Advanced PMCs[1], Glass Fiber-Reinforced PMCs. Steel. and Aluminum

| | Tensile Strength, $\times 10^3$psi | Tensile Modulus, $\times 10^6$ psi | Flexural Strength, $\times 10^3$ psi | Flexural Strength, $\times 10^6$ psi |
|---|---|---|---|---|
| Polyester SMC[5] Glass/Polyester | 2.5 | 30.0 | 1.6 | — |
| Glass/Filament-Wound Epoxy Glass/Polyester, | 12.5 | 1.0 | 27.0 | 0.75 |
| Spray-Up/Lay-Up Glass/Polyester, | 37.0 | 2.25 | 46.0 | 2.25 |
| Woven Roving (Lay-Up) Cold-Rolled, | 48.0 | 30.0 | — | — |
| Low Carbon Steel[7] Wrought Aluminum | 49.0 | 10.2 | — | — |

[1]Property values shown are in longitudinal direction; 2 Union Carbide THORNEL T-300 fibers; 3 DuPont KBVLAR 49; 4 Bulk molding compound; 5 Sheet molding compound; 75AE 1008.

The rigid support spine 32 or 33 may be connected to panels 10 in various ways, for example, the rigid support spine 33 can be inserted in apertures created at the ends of adjacent panels 10 between lip 24 and channel 30. Alternatively, the rigid support spine 33 may be bonded using adhesives to lip 24 or channel 30.

Although the invention has been described in terms of exemplary embodiments, it is not limited thereto. Rather, the appended claim should be construed broadly, to include other variants and embodiments of the invention which may be made by those skilled in the art without departing from the scope and range of equivalents of the invention.

What is claimed is:

1. A finishing panel comprising:

an inner layer of foamed plastic material; and an outer layer of a second plastic material joined to and in direct contact with said inner layer, said outer layer defining a facing surface formed to convey a desired aesthetic effect, and wherein said panel includes at least one elongated siding member, and wherein said panel includes a flange attached to an edge of said panel, and wherein said flange has a planar portion for attachment to a building surface.

2. The panel of claim 1 wherein said panel is an exterior finishing panel suitable for attachment to the exterior of a building.

3. The panel of claim 1 wherein said foamed plastic material and said second plastic material are thermosetting materials.

4. The panel of claim 1 wherein said foamed plastic material and said second plastic material are thermoplastic materials.

5. The panel of claim 4 wherein said foamed plastic material and said second plastic material comprise polyvinyl chloride.

6. The panel of claim 5 wherein said polyvinyl chloride has a tensile strength of about 6000–7500 psi, a percent elongation of about 40–80 percent, a tensile modulus of about $3.5–6\times10^6$ psi and a coefficient of thermal expansion of about $3–10\times10^{-5}$ inch/inch° F.

7. The panel of claim 1 wherein at least said outer layer includes at least one cellulosic additive.

8. The panel of claim 7 wherein said at least one cellulosic additive is selected from the group consisting of hardwood fibers, softwood fibers, wood flour, bamboo, rice, sugarcane and recycled paper products.

9. The panel of claim 1, wherein the second plastic is a non-foamed plastic material.

10. The finishing panel of claim 1, wherein the finishing panel consists of at least two overlapping siding members.

11. The finishing panel of claim 1, wherein the inner layer of foamed plastic material includes a cellulosic material.

12. The panel of claim 1 wherein said flange is attached to an upper edge of said panel.

13. The panel of claim 1, wherein panel has a length and a width, the inner layer extends substantially along the entire length of the panel and the entire width of the panel, and the outer layer extends substantially along the entire length of the panel and the entire width of the panel.

14. A finishing panel comprising:

an inner layer of foamed plastic material; and an outer layer of a second plastic material joined to and in direct contact with said inner layer, said outer layer defining a facing surface formed to convey a desired aesthetic effect, and wherein the panel has a support spine on a rear surface thereof, the support spine comprising an elongated member integrally attached to the inner layer of the panel, and extending along an entire length of the panel, and wherein the support spine projects away from the inner layer and acts as a spacer to hold an intermediate portion of the panel away from a surface to which the panel is mounted.

15. The panel of claim 14, wherein the support spine is formed from a different material than the inner layer and the outerlayer.

16. The panel of claim 14, wherein the inner layer and support spine are formed as part of a single extrusion.

17. The finishing panel of claim 14, wherein the finishing panel comprises two or more connected siding members each having a top and a base, and wherein the support spine projects inwardly away from the base of at least one of the siding members.

18. A finishing panel comprising:

an inner layer of foamed plastic material; and an outer layer of a second plastic material joined to and in direct contact with said inner layer, said outer layer defining a facing surface formed to convey a desired aesthetic effect, and wherein the panel has a support spine extending along a channel, said channel being located at a top of the panel and being formed to receive a second panel.

* * * * *